US006740346B2

(12) United States Patent
Shapiro

(10) Patent No.: US 6,740,346 B2
(45) Date of Patent: May 25, 2004

(54) SYSTEM FOR PACKAGING, STORING AND TRANSPORTING AGRICULTURAL PRODUCE

(75) Inventor: Ariel Shapiro, Herzelia (IL)

(73) Assignee: Stepac L.A., Ltd., Tefen (IL)

( * ) Notice: Subject to any disclaimer, the term of this patent is extended or adjusted under 35 U.S.C. 154(b) by 0 days.

(21) Appl. No.: 09/765,794

(22) Filed: Jan. 19, 2001

(65) Prior Publication Data

US 2002/0096558 A1 Jul. 25, 2002

(51) Int. Cl.[7] ..... B65D 5/56; B65D 81/00

(52) U.S. Cl. ..... 426/124; 426/316; 426/418; 426/419; 229/117.27; 229/117.29; 229/117.3; 229/117.34; 229/120; 220/495.03; 220/495.04; 220/495.05

(58) Field of Search ..... 426/118, 316, 426/326, 419, 411, 418, 124; 229/117.27, 117.3, 117.34, 117.35, 117.29, 120; 220/495.03, 495.05, 495.04, 495.01

(56) References Cited

U.S. PATENT DOCUMENTS

| | | | | | |
|---|---|---|---|---|---|
| 3,087,655 | A | * | 4/1963 | Scholle | 222/183 |
| 3,450,542 | A | * | 6/1969 | Badran | 426/106 |
| RE28,892 | E | | 7/1976 | Esty | 229/14 B |
| 4,163,494 | A | * | 8/1979 | Stollberg | 206/423 |
| 4,474,020 | A | | 10/1984 | Freeman | 62/89 |
| 4,494,363 | A | | 1/1985 | Rica et al. | 53/426 |
| 4,513,907 | A | * | 4/1985 | Grosshuesch | 229/23 R |
| 4,535,586 | A | | 8/1985 | Eberle | 53/432 |
| 4,790,436 | A | * | 12/1988 | Nakamura | 206/449 |
| 4,899,517 | A | | 2/1990 | Shima et al. | 53/432 |
| 4,981,007 | A | | 1/1991 | Shima et al. | 53/432 |
| 5,180,075 | A | * | 1/1993 | Montalbano | 229/103.11 |
| 5,354,569 | A | | 10/1994 | Brown et al. | 426/411 |
| 5,421,138 | A | | 6/1995 | Muise et al. | 53/440 |
| 5,505,305 | A | * | 4/1996 | Scholz et al. | 206/438 |
| 5,505,950 | A | | 4/1996 | Floyd et al. | 426/404 |
| 5,556,658 | A | | 9/1996 | Raudalus et al. | 426/411 |
| 5,575,418 | A | * | 11/1996 | Wu et al. | 229/5.81 |
| 5,609,293 | A | * | 3/1997 | Wu et al. | 229/5.81 |
| 5,617,711 | A | * | 4/1997 | Rodriguez et al. | 53/475 |
| 5,619,841 | A | | 4/1997 | Muise et al. | 53/440 |
| 5,727,676 | A | | 3/1998 | Tatsu et al. | 206/204 |

* cited by examiner

*Primary Examiner*—Robert Madsen
(74) *Attorney, Agent, or Firm*—Ladas & Parry

(57) ABSTRACT

A system and method for packing agricultural produce including functionality for:

providing a container having at least one communications aperture formed in a wall thereof;

providing at least one flexible controlled permeability bag within the container;

providing at least one bag aperture in the at least one flexible controlled permeability bag in general registration with the at least one communications aperture;

sealing the produce inside the at least one flexible controlled permeability bag within the container, while leaving the at least one bag aperture and the at least one communications aperture open;

providing atmosphere treatment within the at least one bag via the at least one bag aperture and the at least one communications aperture; and sealing at least one of the at least one bag aperture and the at least one communications aperture.

16 Claims, 13 Drawing Sheets

22
24
26
25
20
10
22
20
26
25
24
26
16
22

SYSTEM FOR PACKAGING, STORING AND TRANSPORTING AGRICULTURAL PRODUCE

FIELD OF THE INVENTION

The present invention relates to methodologies and systems for packaging, storing and transporting agricultural produce generally.

BACKGROUND OF THE INVENTION

There are known various techniques and systems for packaging, storing and transporting agricultural produce. The following US patents are believed to represent the state of the art: U.S. Pat. Nos. 5,421,138; 4,535,586; 4,981,007; 4,899,517. The known conventional techniques have significant limitations and disadvantages.

SUMMARY OF THE INVENTION

The present invention seeks to provide improved methodologies and systems for packaging, storing and transporting agricultural produce, which result in significant efficiencies and cost savings, without sacrificing product quality.

In the present specification and claims, the following terms are used: "bag" which relates to a container for agricultural produce in which a "Modified Atmosphere" condition is established by controlling the amounts and relationships of the appropriate gas components, which are required for extending the storage and shelf life of the agricultural product, for example agricultural produce, flowers and bulbs. "vapor" relates to liquids in the form of a gas or a gas with free floating water droplets, as for example, in condensation. "carton" relates to containers or boxes constructed from materials such as plastic, wood or metal, for storing agricultural products. "adhesive" relates to a sealing element for a venting closure system, by using such devices as a latch, cap-locking system or an adhesive sticker.

There is thus provided in accordance with a preferred embodiment of the present invention a method for packing agricultural produce including the steps of:

- providing a container having at least one communications aperture formed in a wall thereof;
- providing at least one flexible controlled permeability bag within the container;
- providing at least one bag aperture in the at least one flexible controlled permeability bag in general registration with the at least one communications aperture;
- sealing the produce inside the at least one flexible controlled permeability bag within the container, while leaving the at least one bag aperture and the at least one communications aperture open;
- providing atmosphere treatment within the at least one bag via the at least one bag aperture and the at least one communications aperture; and
- sealing at least one of the at least one bag aperture and the at least one communications aperture.

There is also provided in accordance with a preferred embodiment of the present invention, a system for packing agricultural produce including:

- at least one container having at least one communications aperture formed in a wall thereof;
- at least one flexible controlled permeability bag within the container, the at least one bag having an aperture in general registration with the at least one communications aperture and being adapted for containing the produce inside the at least one flexible controlled permeability bag within the container, while leaving the at least one bag aperture and the at least one communications aperture open;
- treatment functionality, operative for providing atmosphere treatment within the at least one bag via the at least one bag aperture and the at least one communications aperture; and
- sealing functionality for sealing at least one of the at least one bag aperture and the at least one communications aperture.

According to a preferred embodiment of the present invention, the atmosphere treatment includes vacuum cooling.

Additionally or alternatively, the atmosphere treatment includes at least one of fumigation or other gas treatment, such as ripening treatment.

Preferably, the at least one communications aperture formed in a wall thereof is formed in a sealing layer adhered to a wall of the carton.

In accordance with a preferred embodiment of the present invention, the flexible controlled vapor and gas selective permeability bag includes a gas impermeable bag, preferably a gas permeable bag having selected permeability characteristics adapted to a given type of produce.

Preferably, the methodology of providing at least one bag aperture in the flexible controlled permeability bag in general registration with the at least one communications aperture includes:

- inserting the bag into the container;
- at least partially filling the bag with the produce;
- adhering the bag to the container adjacent the at least one communications aperture; and
- aperturing the bag generally in registration with the at least one communications aperture.

Where the at least one communications aperture formed in a wall thereof is formed in a sealing layer adhered to a wall of the carton, the functionality of providing at least one bag aperture in the flexible controlled permeability bag in general registration with the at least one communications aperture includes:

- inserting the bag into the container;
- at least partially filling the bag with the produce;
- adhering the bag to the container adjacent the at least one communications aperture; and
- aperturing the bag and the sealing layer in a single operation.

Preferably, the sealing at least one of the at least one bag aperture and the at least one communications aperture includes attaching an adhesive sticker or a cap over the at least one communications aperture from the outside of the container.

There is also provided in accordance with a preferred embodiment of the present invention a box suitable for packing agricultural produce and including at least one sealable localized atmosphere communication aperture formed in a wall thereof.

Preferably, the carton also includes a plurality of ventilation apertures formed in at least one wall thereof.

In accordance with a preferred embodiment of the present invention, the carton also includes a gas impervious layer arranged for sealing engagement with the at least one sealable localized atmosphere communication aperture.

Preferably, the box includes an interiorly disposed bag, which is preferably a modified atmosphere bag.

Preferably, the sealing layer is an adhesive-coated plastic sticker and the bag is adhered to the adhesive-coated plastic sticker. In accordance with a preferred embodiment of the present invention, the bag and the adhesive-coated plastic sticker are both apertured adjacent the sealable localized atmosphere communication aperture, thereby to provide a fluid communication pathway between the interior of the bag and the exterior of the carton. A further gas impervious sealing layer may be employed for subsequently sealingly engaging the adhesive-coated plastic sticker, thereby sealing the interior of the bag from the exterior of the carton.

Additionally in accordance with a preferred embodiment of the present invention, there is provided a method for loading a refrigerated container having a refrigeration unit producing a flow of forced air and a flow of return air under negative pressure in order to provide maximum loading and cooling efficiency, the method including:

loading palletized ventilated cartons having ventilating apertures formed in walls thereof into a refrigerated shipping container in a manner such that there is defined a central plenum between rows of loaded pallets; and selectively blocking air passages inside the container such that the forced air flow is directed principally through the plenum and through interstices between ones of the ventilated containers and thus generally horizontally through the ventilating apertures.

There is additionally provided in accordance with a preferred embodiment of the present invention, a loaded refrigerated container having a refrigeration unit producing a flow of forced air and a flow of return air under negative pressure in order to provide maximum loading and cooling efficiency, the loaded container also including:

palletized ventilated cartons having ventilating apertures formed in walls thereof positioned in the refrigerated shipping container in a manner such that there is defined a central plenum between rows of loaded pallets and wherein air passages inside the container are selectively blocked, such that the forced air flow is directed principally through the plenum, through interstices between ones of the ventilated containers and thus generally horizontally through the ventilating apertures.

In accordance with a preferred embodiment of the present invention, a forced air flow from the refrigeration unit is supplied along channels formed in a floor of the container and extending parallel to a longitudinal axis thereof; at least a portion of the forced air output rises through spaces between adjacent floor elements in the floor of the shipping container, except where physically blocked and relatively unimpeded from a channel underlying the plenum; and at least a portion of the forced air output rises relatively unimpeded from open ends of the channels at a back end of the container into back plenum defined rearwardly of the rows of pallets

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Reference is made to FIGS. 1A–1G, which are simplified pictorial illustrations of seven initial stages in packaging produce in accordance with a preferred embodiment of the present invention.

Figure 1A:
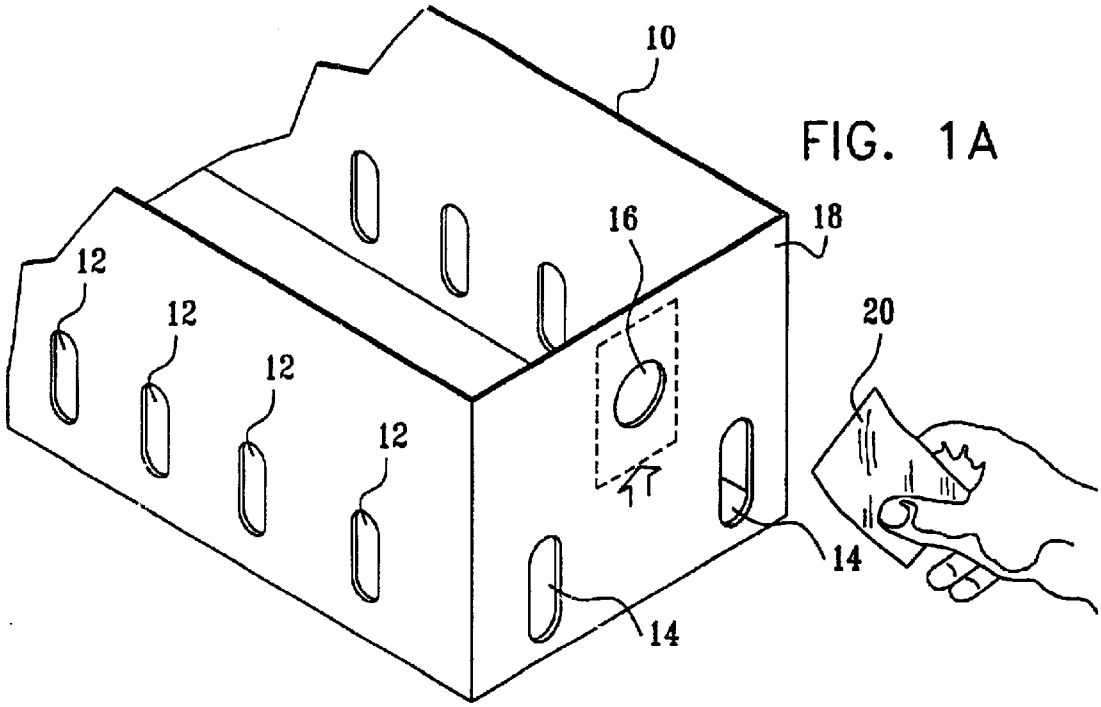
FIGS. 1A–1G are simplified pictorial illustrations of seven initial stages in packaging produce in accordance with a preferred embodiment of the present invention.

As seen in FIG. 1A, a packing carton 10 is provided, preferably having side apertures 12 and end apertures 14 as well as at least one sealable localized atmosphere communication aperture 16, preferably formed in an end 18 of carton 10, near the top thereof. In accordance with a preferred embodiment of the invention, packing carton 10 need not be liquid impervious, such as a waxed container, and may thus be a relatively inexpensive uncoated and unwaxed cardboard box.

Figure 1B:
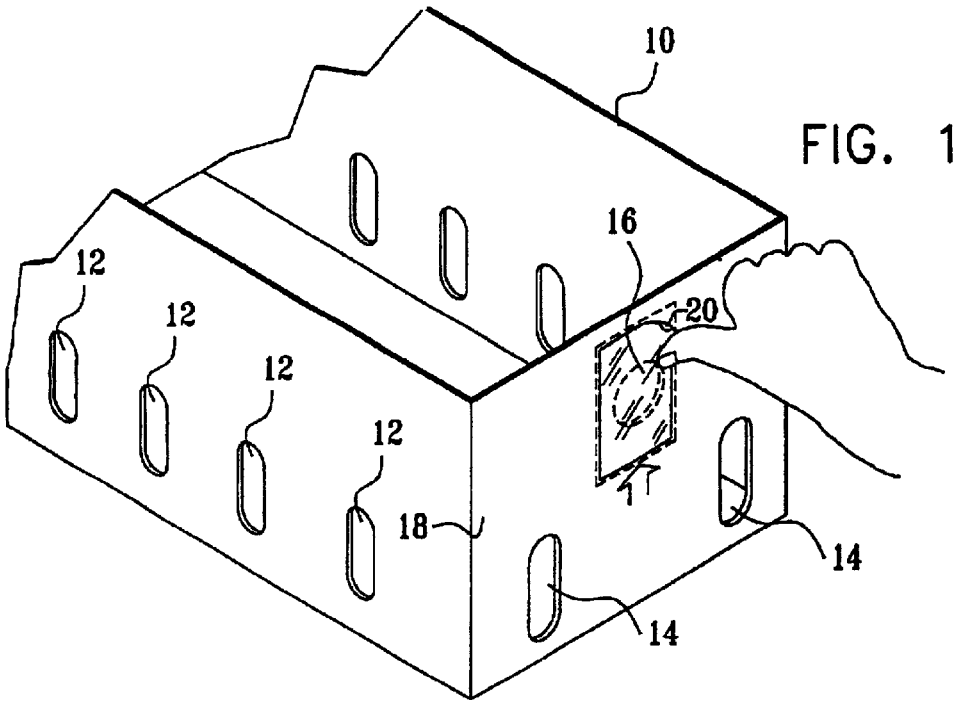

In accordance with a preferred embodiment of the invention, as shown in FIG. 1B, the sealable localized atmosphere communication aperture 16 preferably is sealed by attaching thereover a gas impervious sealing layer 20, typically a self adhesive-coated plastic sticker. Sealing of aperture 16 may take place at any suitable time or location. Typically it is carried out during manufacture of the carton. Normally it is carried out prior to filling of the carton.

Figure 1C:
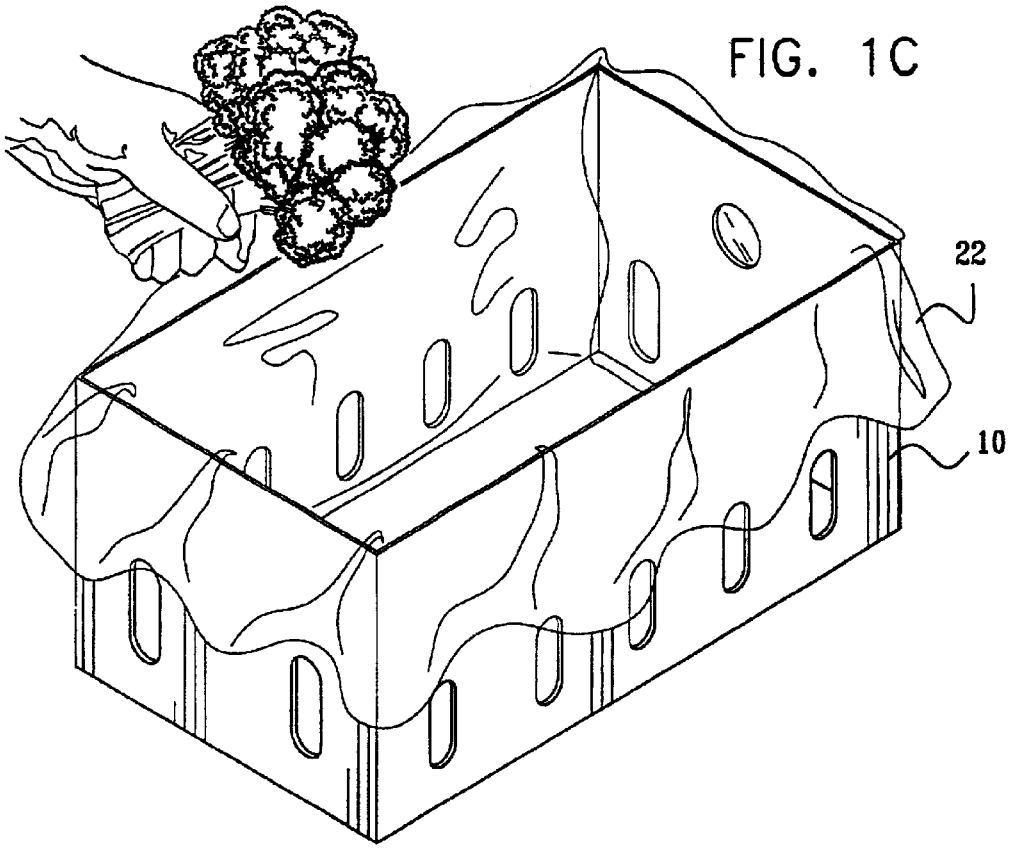
Figure 1D:
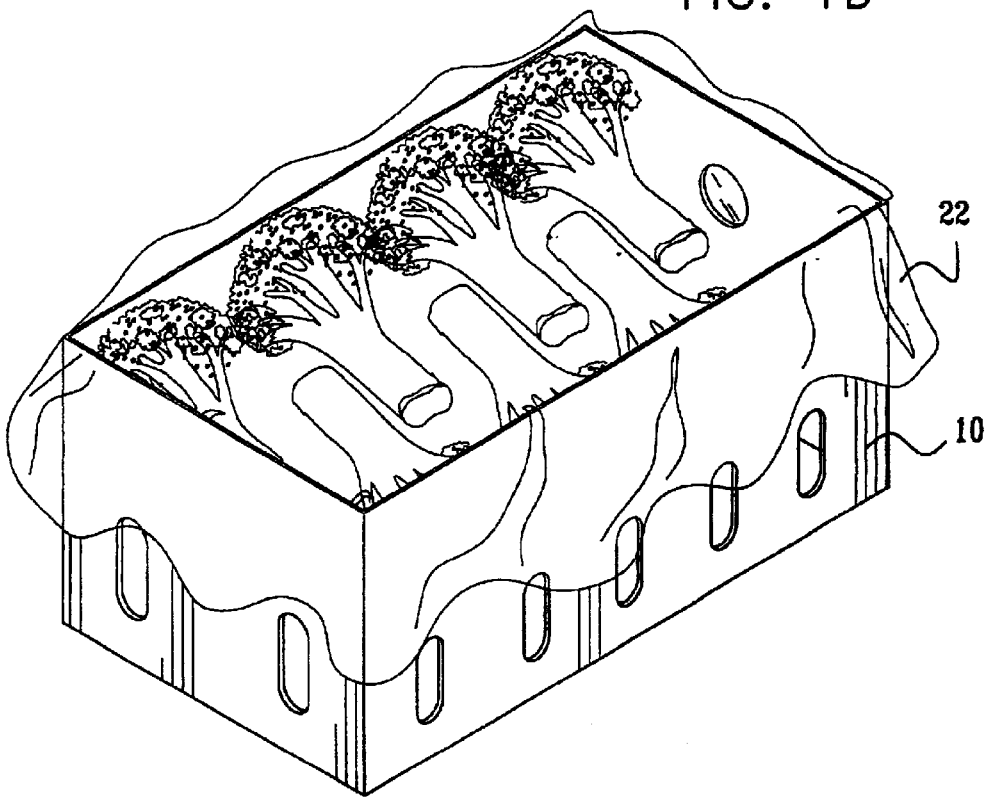

FIG. 1C shows insertion of a flexible bag 22, such as a plastic bag, as a liner within carton 10. The bag 22 is preferably a modified atmosphere bag, such as that described in assignee's U.S. patent application Ser. No. 08/918,584 to Moira M. Nir et al, assigned to StePac L. A., Ltd., Tefen Industrial Park, Tefen Western Galilee, Israel, the disclosure of which is hereby incorporated by reference. The bag 22, and thus the carton 10, is then filled with produce, as seen in FIG. 1D.

Figure 1E:
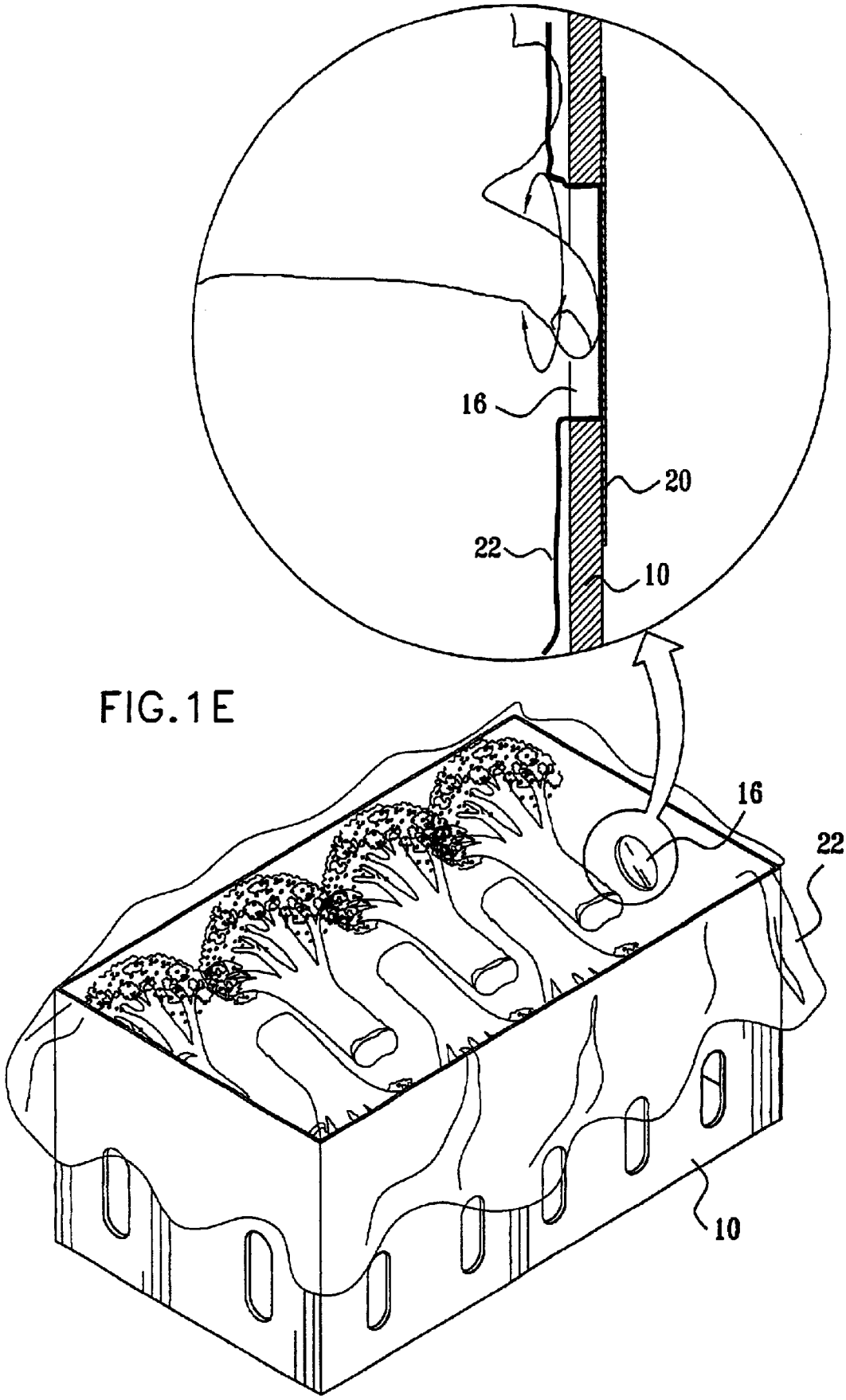

As seen in FIG. 1E, subsequent to or concurrently with filling the bag 22 with produce and prior to sealing of bag 22, the portion of the bag 22 which lies adjacent aperture 16, when the carton is filled with produce, is adhered to sealing layer 20.

In the illustrated preferred embodiment of the present invention, where sealing layer 20 is an adhesive-coated plastic sticker, the adherence of bag 22 thereto may be achieved by manually pressing a suitable area of the bag 22 onto an adhesive-coated inside facing surface of sealing layer 20, as shown in FIG. 1E.

It is appreciated that if sealing layer 20 is adhered to carton 10 during manufacture of the carton or at any stage prior to filling of the carton with produce, the adhesive-coated surface thereof which overlies aperture 16 must be protected, as by a removable release layer (not shown), which can be readily removed prior to the stage shown in FIG. 1E, preferably following the stage shown in FIG. 1C, so as to avoid inadvertent, undesired adherence between the layer 20 and a location on the bag 22 which is not the desired location.

Figure 1F:
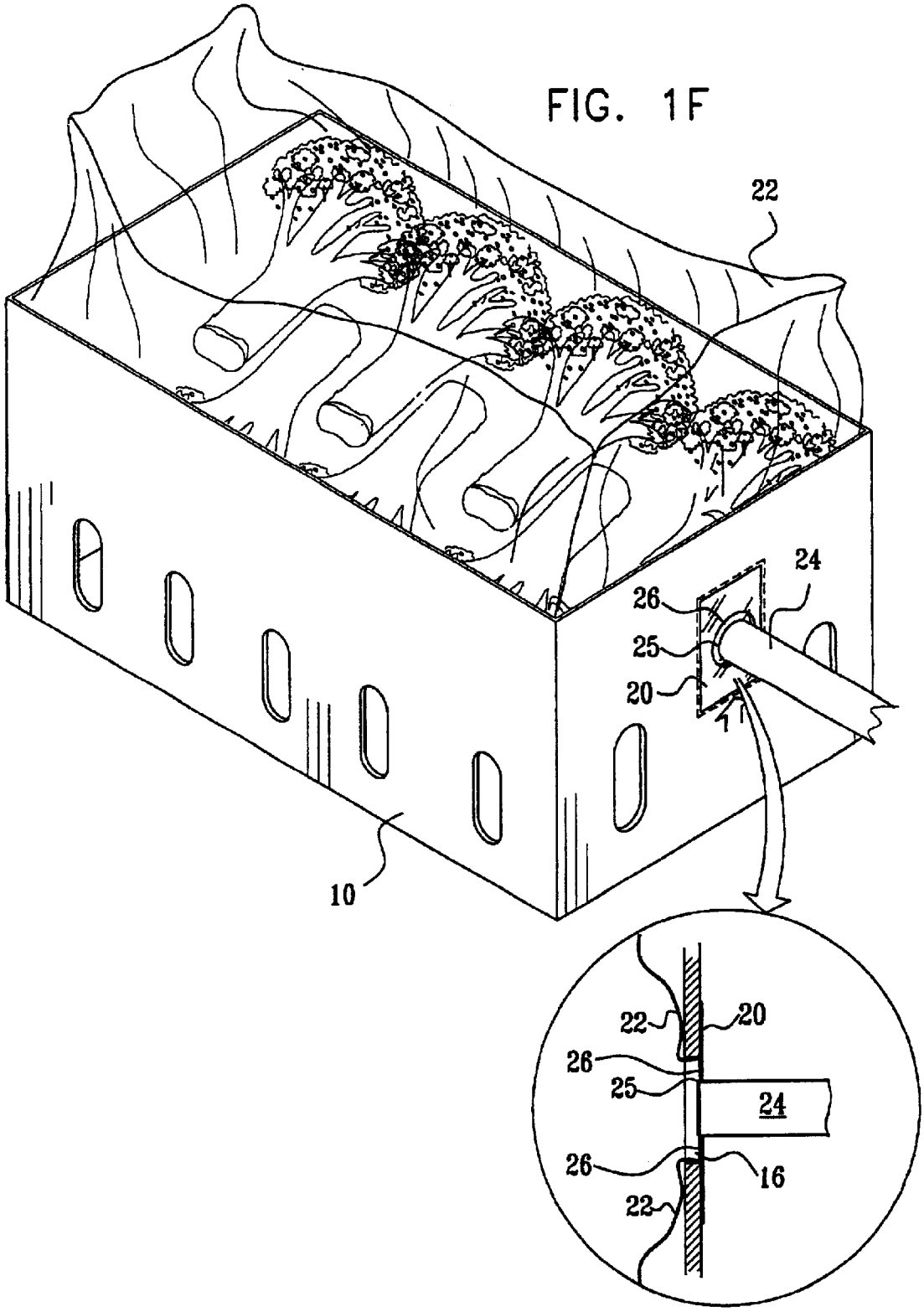

Following adherence of the bag 22 to sealing layer 20, or any equivalent adherence of the bag 22 to the carton 10 in the region of aperture 16, the bag 22 and sealing layer 20 are apertured at aperture 16, thereby defining an atmosphere communication pathway therethrough. One example of this functionality is illustrated in FIG. 1F, wherein a heated, preferably generally cylindrical aperturing element 24, is inserted via aperture 16, thus defining an aperture 25 through sealing layer 20 and the bag 22. The aperture 25 is surrounded by an annular zone 26 of the sealing layer 20. The bag 22 is sealed to sealing layer 20 at annular zone 26.

It is appreciated that there may exist a large variety of techniques for defining the aperture 25 in the sealing layer 20 and the bag 22 in registration with aperture 16. While it is believed that the technique described hereinabove with reference to FIGS. 1A–1F is preferred, the scope present invention need not be limited thereto.

Figure 1G:
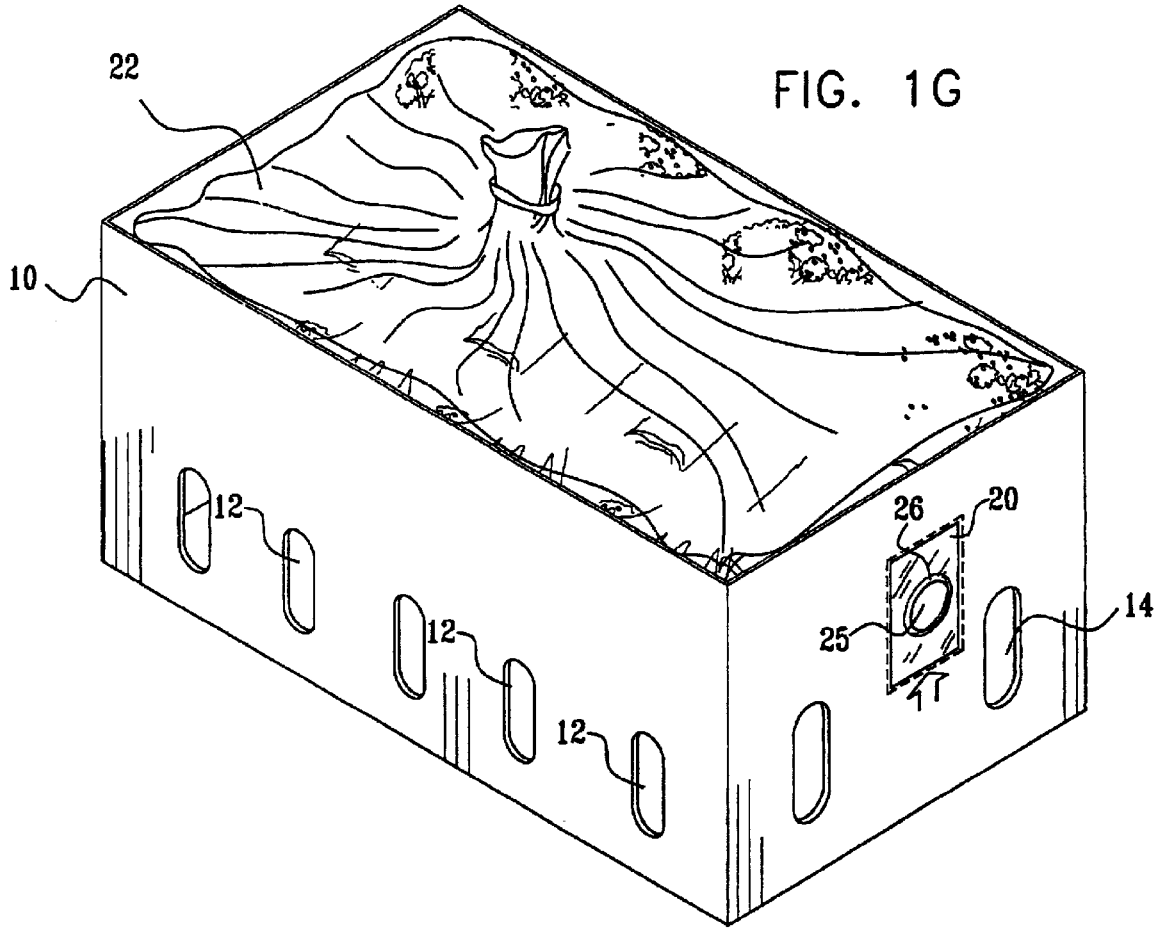

Following completion of the stage shown in FIG. 1F, the bag 22 is sealed, as shown in FIG. 1G, and the carton 10 is closed.

Reference is now made to FIGS. 2A–2D, which are simplified pictorial illustrations of four stages in treating produce packaged in accordance with the embodiment of FIGS. 1A–1G.

Figure 2A:
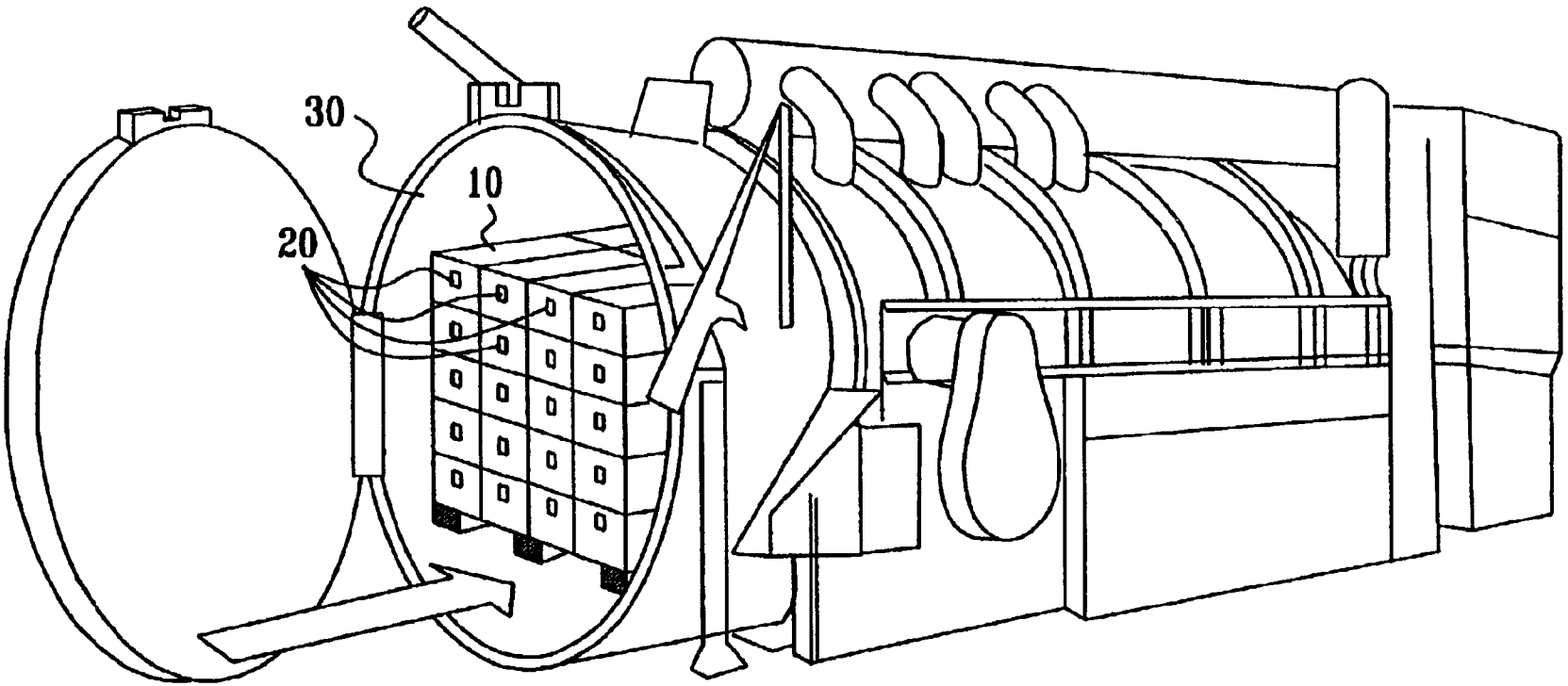
FIGS. 2A–2C are simplified pictorial illustrations of three stages in treating produce packaged in accordance with the embodiment of FIGS. 1A–1G.

As seen in FIG. 2A, the filled cartons 10, each having an open aperture communicating with the interior of bag 22, are preferably palletized and inserted into a treatment chamber 30, such as a vacuum cooling chamber, a fumigation chamber, a gas treatment chamber or a chamber providing multiple functions, such as vacuum cooling and gas treatment. The arrangement of the cartons 10 within treatment chamber 30 is such that apertures 16 and thus the interiors of bags 22 within cartons 10 are all in fluid communication with the interior of treatment chamber 30. In such a way, the contents of the bags 22 within cartons 10 are exposed to the environment of the interior of the treatment chamber 30, as seen in FIG. 2B for a vacuum cooling application.

Figure 2B:
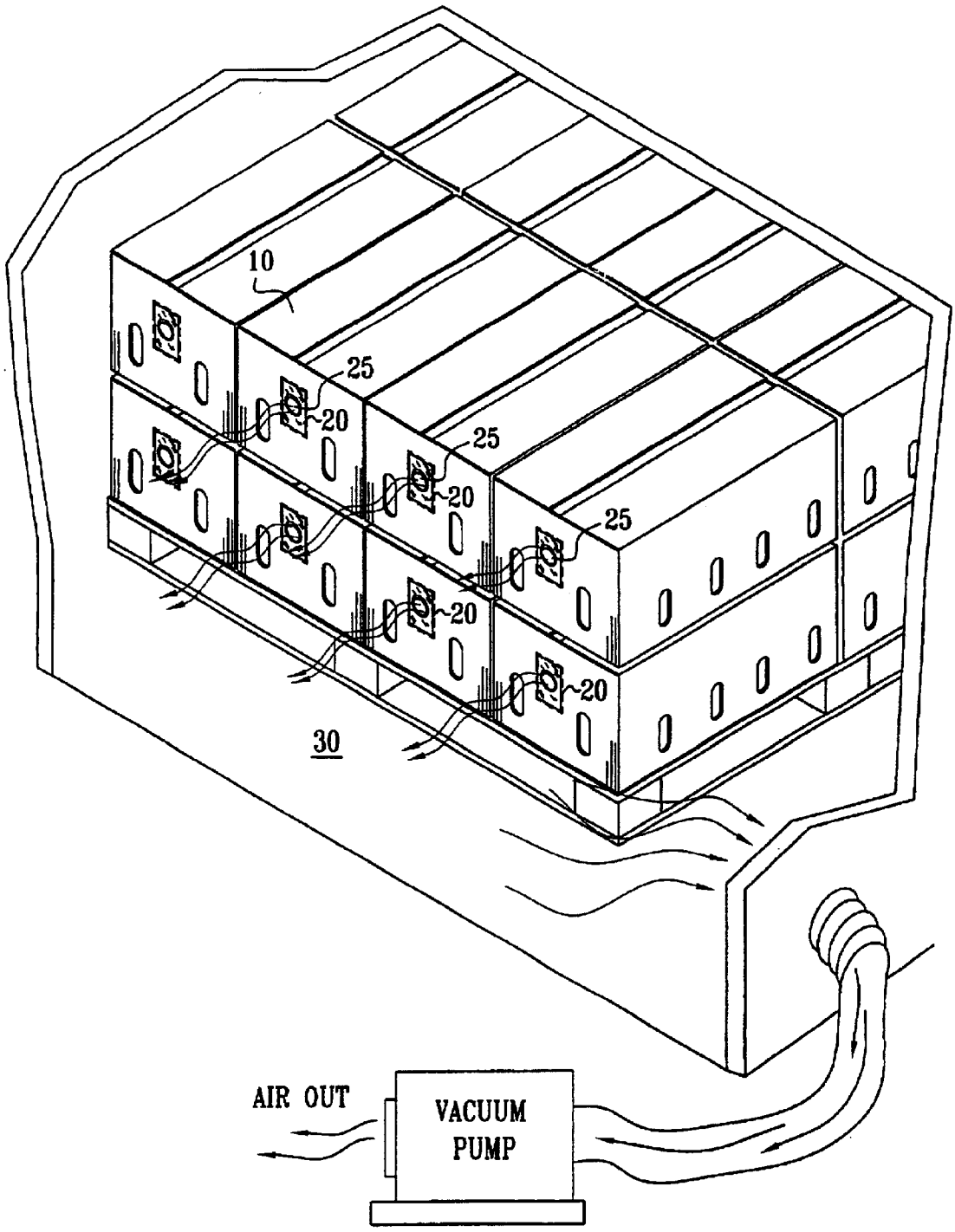
Figure 2C:
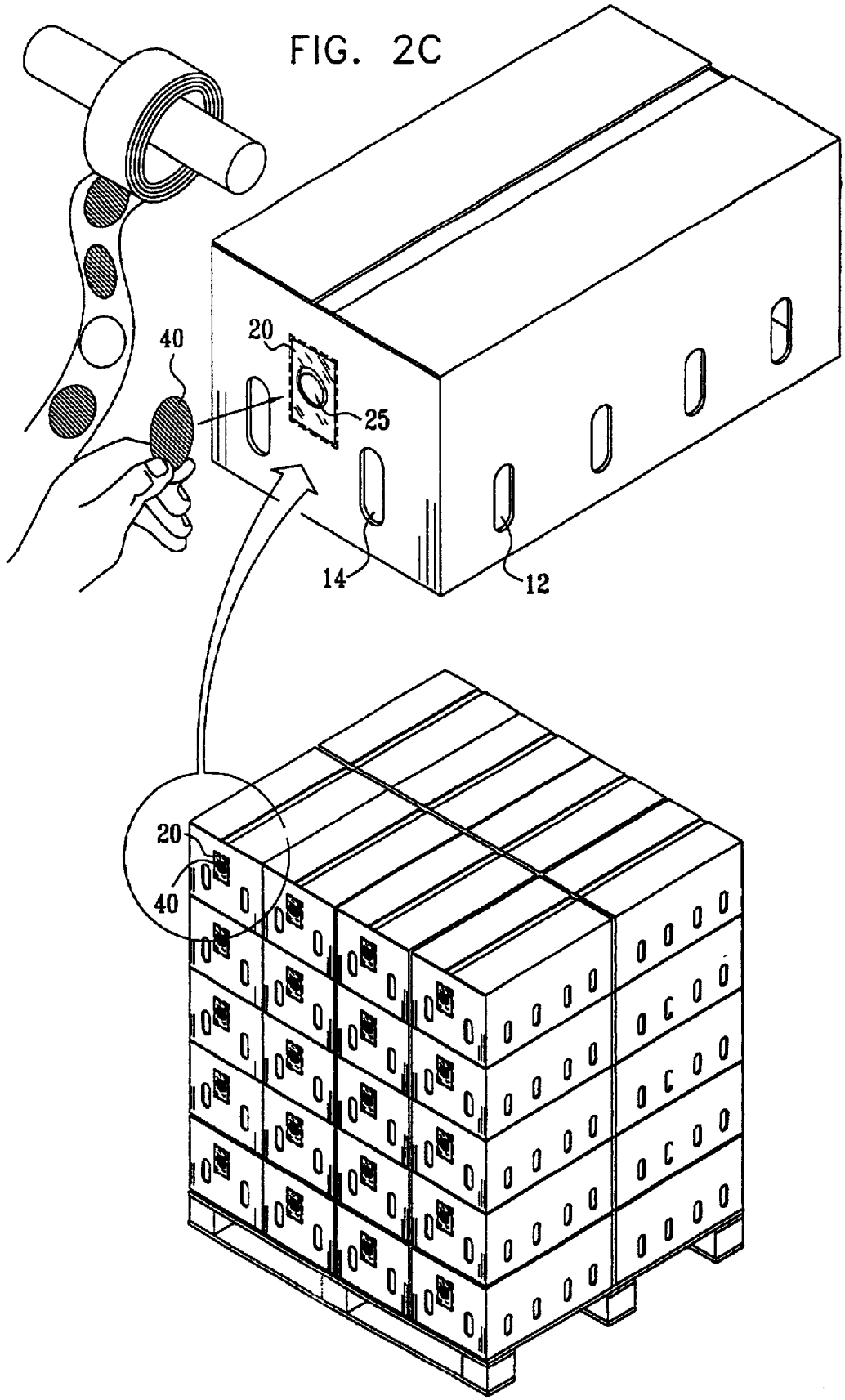

Following vacuum cooling and/or other treatment as shown in FIGS. 2A & 2B, but without requiring repalletization, the apertures 16 are preferably sealed by attaching a gas impermeable layer 40 onto the outside of the carton 10, preferably over layer 20, as shown in FIG. 2C. This seals the interior of the bag 22 from the outside atmosphere, thereby enabling maintenance of a modified atmosphere within bag 22.

Figure 3A:
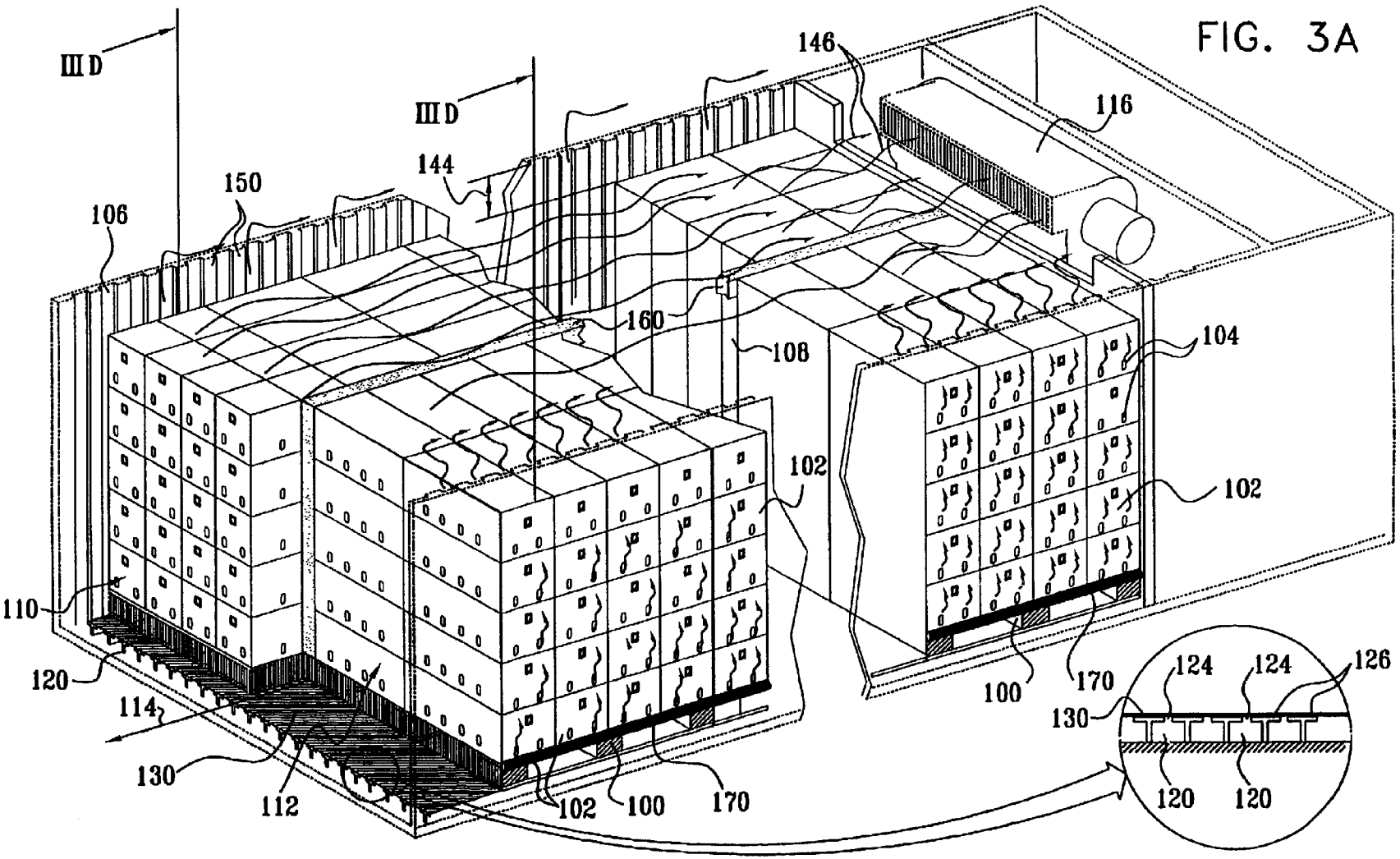
FIGS. 3A–3C are simplified pictorial illustrations of a methodology for loading a refrigerated container to provide maximum loading and cooling efficiency.
Figure 3B:
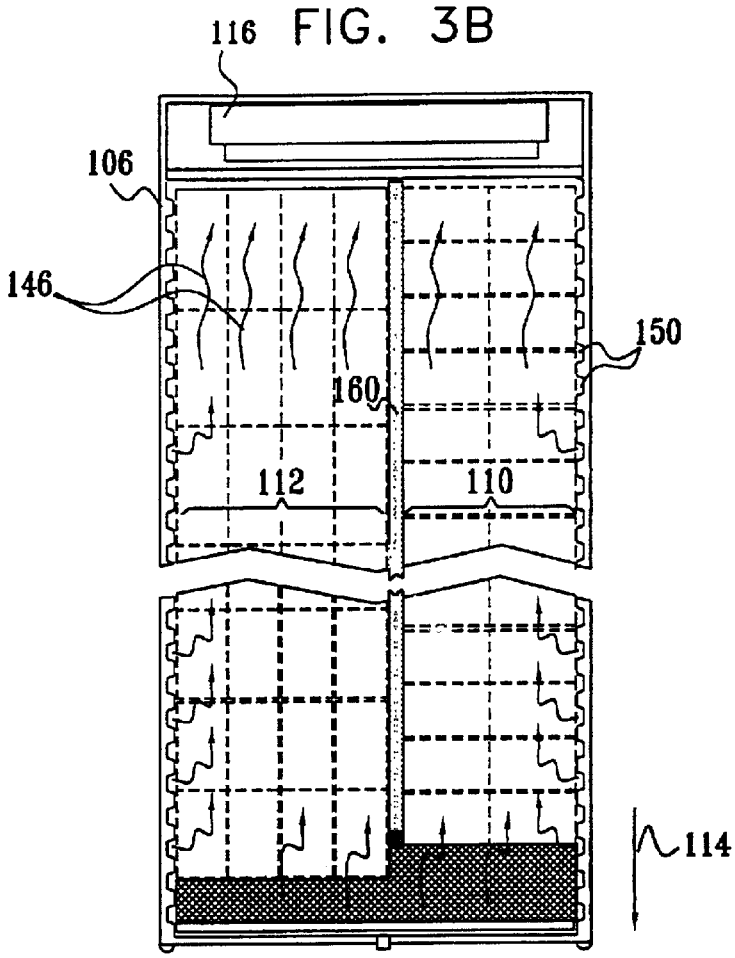
Figure 3C:
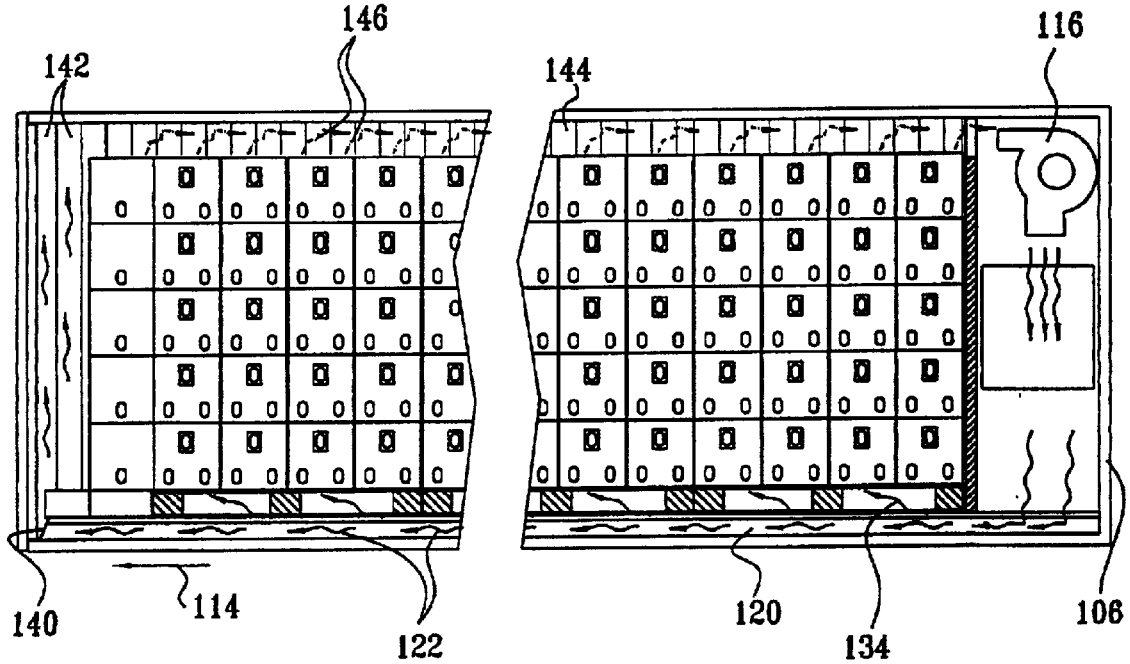

Reference is now made to FIGS. 3A–3C, which are simplified pictorial illustrations of a methodology for loading a refrigerated container to provide maximum loading and cooling efficiency. As seen in FIGS. 3A–3C, pallets 100, having loaded thereon ventilated cartons 102, having ventilating apertures 104 formed in walls thereof, are loaded into a container 106 in a manner such that there is defined a central plenum 108 between two rows of loaded pallets 100.

In a preferred embodiment of the invention, the interior width of the refrigerated container 106 is approximately 2.3 meters, the interior length of the container is approximately 11.6 meters and the pallets preferably have dimensions of 1 meter by 1.2 meters. The pallets 100 are preferably arranged in touching engagement with each other to define rows 110 and 112, as seen in FIGS. 3A and 3B. Additionally, the pallets 110 and 112 are in touching engagement with the side walls of the container 106 (FIGS. 3A and 3B). The pallets in row 110 being arranged to have their relatively smaller dimension parallel to the longitudinal axis 114 of the container 106, and the pallets in row 112 being arranged to have their relatively greater dimension parallel to the longitudinal axis 114 of the container 106 (FIGS. 3A and 3B).

Forced air output from a refrigeration unit 116 is supplied along channels 120 (FIGS. 3A and 3C) formed in a floor 130 of the container 106 and extending parallel to longitudinal axis 114 thereof, as illustrated by arrows 122. This forced air rises through spaces 124 between adjacent floor elements 126 in the floor of the container 106, except where physically blocked.

Thus, it may be appreciated that a major portion of the forced air rises relatively unimpeded from the channels 120, underlying the rows 110 and 112, through plenum 108 via elongate longitudinal openings 124 interconnecting channels 120 with plenum 108, as indicated by arrows 134.

Forced air also rises relatively unimpeded from the open ends 140 of channels 120 at the back end of the container into a plenum 142 defined rearwardly of rows 110 and 112 of pallets 110. Plenums 108 and 142 communicate with a plenum 144 at the top of the container above palletized cartons 102, and which serves as an air return plenum communicating with the refrigeration unit 116, as indicated by arrows 146. Typically air in air return plenum 144 is sucked into the refrigeration unit 116 under negative pressure.

Forced air also rises from various channels 120 via spaces 124 in a somewhat impeded manner via the interstices between adjacent palletized cartons 102 and eventually reaches air return plenum 144.

Additionally forced air rises alongside outer facing surfaces of palletized cartons 102 in vertical channels 150 typically formed by corrugations in the walls of the container 106 and reaches air return plenum 144. This flow preferably is not allowed to extend directly from channels 120 but rather is a negative pressure flow which draws cooled air via the interstices between cartons 102.

It is a particular feature of the present invention that generally horizontal air movement is provided through the ventilation openings 104 in the cartons 102 for efficient cooling of the contents thereof. This is true both in the atmosphere treatment described hereinabove with reference to FIGS. 2A–2C and in the refrigerated container loading and cooling arrangements described herein with reference to FIGS. 3A–3C. In the embodiment shown in FIGS. 3A–3C, the horizontal air movement is provided by suitable arrangement of the palletized cartons as described hereinabove and the definition of a plenum between rows of palletized cartons. Both the arrangement of the cartons on the pallets and the arrangement of the pallets in the container are important in this regard.

The various forced air flows described hereinabove cause air to penetrate through ventilating apertures 104 in palletized cartons 102 and thus to communicate with the interior of the cartons 102. In an embodiment where the cartons 102 contain a sealed bag therewithin, such as that shown in FIGS. 2A–2C, the exterior of the sealed bags is exposed to cooled air, for providing suitable cooling of the interior of the bags.

In accordance with a preferred embodiment of the present invention, spaces 124 which do not underlie pallets 100 are preferably blocked, as by provision of a flexible self-retaining blocking element, such as a closed cell sponge 160. Similarly, the end of plenum 108 is blocked as by provision of a sponge 160 and the exposed edges of the most rearward positioned pallets 100 in rows 110 and 112 are similarly blocked by sponges 160. This blocking and the above-described arrangement of pallets in the container 106 provides enhanced contact between air flows and the interiors of cartons 102 via apertures 104.

Figure 3D:
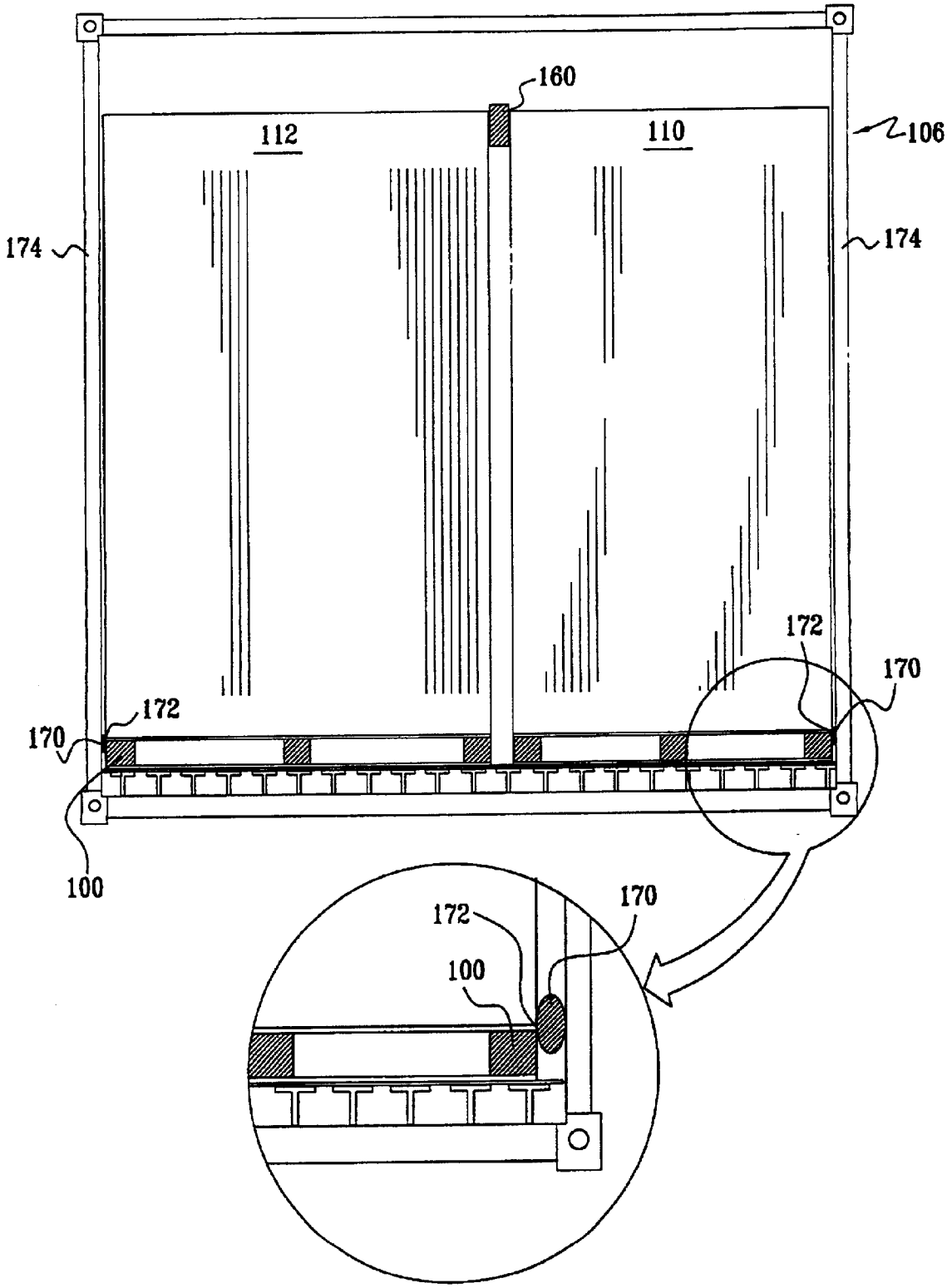
FIG. 3D is a simplified cross-sectional view, taken along lines IIID—IIID in FIG. 3A, showing the location of a blocking element, in accordance with another preferred embodiment of the invention.

Reference is now made to FIG. 3D, which is a cross-sectional view of the container 106 and the pallets 100, taken along lines IIID—IIID in FIG. 3A. In FIG. 3D it is seen that blocking elements 170 are attached to side walls 172 of the upper deck of the pallet 100. On inserting the pallet 100 into the container 106, the blocking elements 170 form tight seals between the pallets 100 and side walls 174 of the container 106. The blocking elements 170 prevent the escape of the cooling air around the sides of the container 106 and ensures that the cooling air flows through the plenum 108 and the vertical channels 150 in order to provide efficient cooling to the produce contained within the cartons 102, as described hereinabove.

It is appreciated that the blocking elements 170 are preferably constructed of resilient material so as to provide adequate sealing between the carton rows 110 and 112 and the side walls 174 of the container 106, as illustrated in FIG. 3D.

Figure 4A:
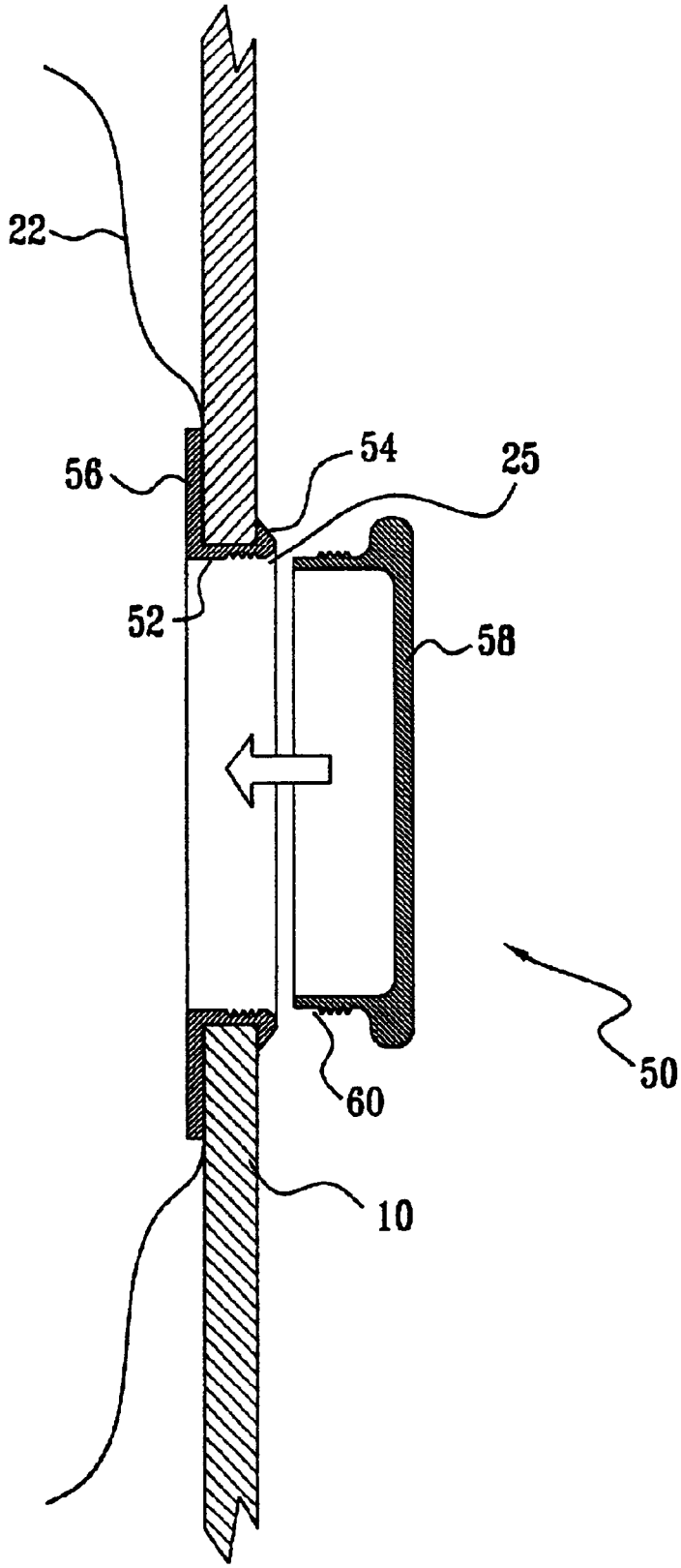
FIG. 4A is a simplified illustration of a sealing element for packaging produce, in accordance with a preferred embodiment of the present invention.

Reference is now made to FIG. 4A, which shows a sealing element 50 for packaging produce in the carton 10, in accordance with a preferred embodiment of the present invention. The sealing element 50 comprises a sealing device 52, preferably in the shape of a ring. The sealing device 52 typically comprises locking elements 54 and 56 for sealing the bag 22 to the carton 10, as shown in FIG. 4A. A plug member 58 with sealing member 60, is pushed into the aperture 25, as illustrated in FIG. 4A, to seal the inside of the carton 10 from the outside environment.

Figure 4B:
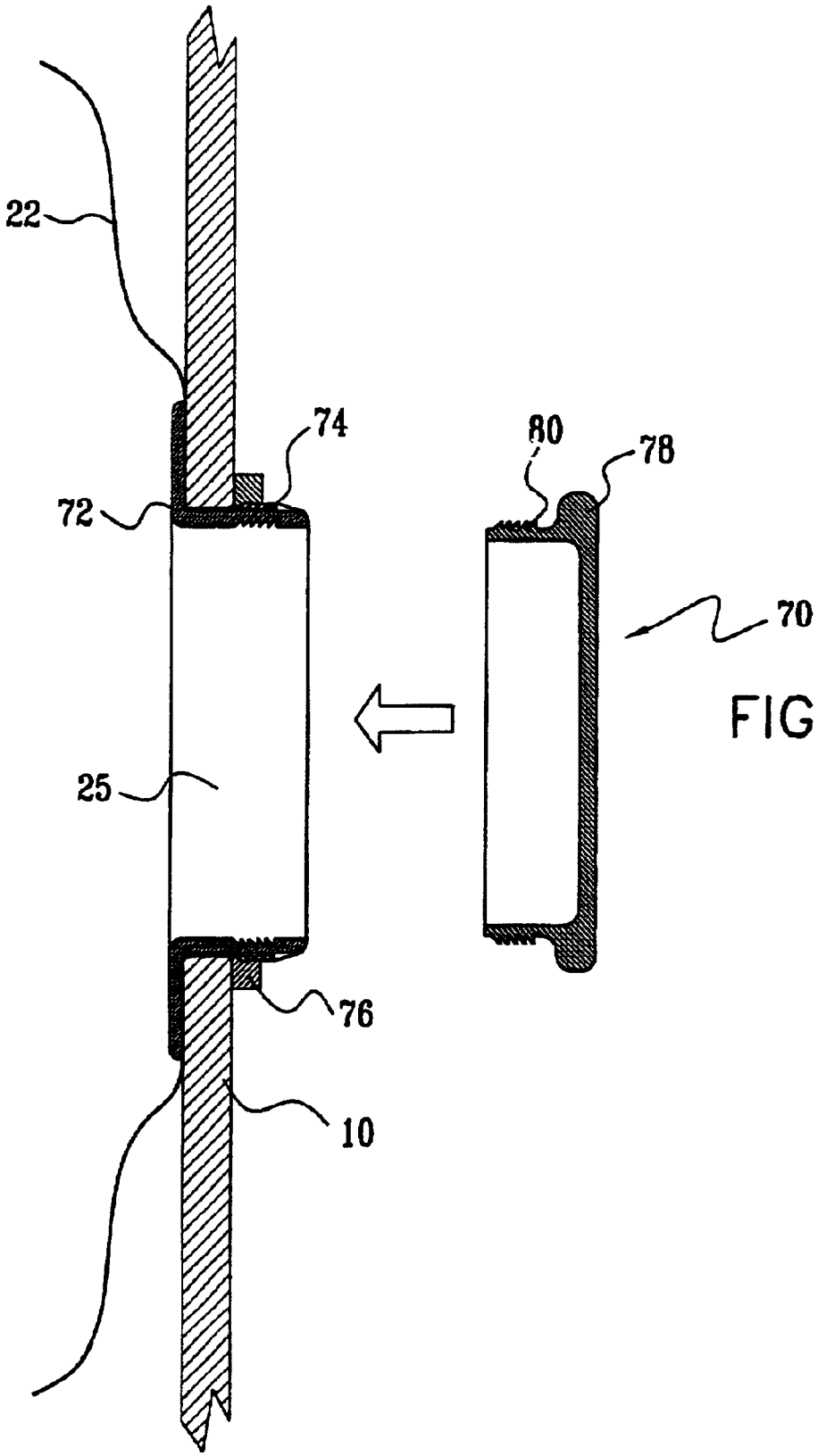
FIG. 4B is a simplified illustration of another type of sealing element for packaging produce in accordance with another preferred embodiment of the invention.

Reference is now made to FIG. 4B, which shows another type of sealing element 70 for packaging produce in the carton 10, in accordance with another preferred embodiment of the invention. The sealing element 70 comprises a clasp 72, with a screw head 74, which is inserted into the aperture 25. A ring 76 is screwed onto the clasp 72 thus sealing the bag 22 to the carton 10, as shown in FIG. 4B. A cover member 78 with a sealing member 80 is pushed into the aperture 25, thereby sealing the inside of the carton 10 from the outside environment.

It is appreciated that the shapes of the sealing elements described hereinabove are constructed so as to conform to the shape and dimensions of the carton 10.

It is also appreciated that the embodiments described hereinabove, for sealing the bag 22 to the carton 10, are suitable for any type of receptacle, such as corrugated carton, plastic boxes or any type of agricultural storage container, which is used for packaging agricultural produce, as is known in the art.

It will be appreciated by persons skilled in the art that the present invention is not limited by what has been particularly shown and described hereinabove. Rather the scope of the present invention includes both combinations and sub-combinations of the various features described hereinabove as well as variations and modifications which would occur to persons skilled in the art upon reading the specification and which are not in the prior art.

What is claimed is:

1. A package suitable for packing agricultural produce comprising:

a box having a plurality of ventilation apertures formed in at least one wall thereof;

an interiorly disposed bag which is a water vapor permeable plastic bag;

at least one sealable localized atmosphere communication aperture formed in a wall of said box and communicating with the interior of said bag; and a sealing element, located in said at least one sealable localized atmosphere communication aperture, operative to seal said bag to said box.

2. A package according to claim 1 and also comprising a gas impervious layer arranged for sealing engagement with said at least one sealable localized atmosphere communication aperture.

3. A package according to claim 2 and wherein said sealing layer is an adhesive-coated plastic sticker.

4. A package according to claim 3 and wherein said bag is adhered to said adhesive-coated plastic sticker.

5. A package according to claim 4 and wherein said bag and said adhesive-coated sticker are both apertured adjacent said sealable localized atmosphere communication aperture, thereby to provide a fluid communication pathway between the interior of the bag and the exterior of the package.

6. A package according to claim 5 and also comprising a further gas impervious sealing layer sealingly engaging said adhesive-coated sticker, thereby sealing the interior of the bag from the exterior of the package.

7. A package according to claim 2 and wherein said sealing layer is an adhesive-coated sticker.

8. A package according to claim 7 and wherein said bag is adhered to said adhesive-coated sticker.

9. A package according to claim 1 and wherein said bag is a modified atmosphere bag.

10. A package according to claim 9 and wherein said bag is filled with agricultural produce.

11. A package according to claim 1 and wherein said bag is filled with agricultural produce.

12. A package according to claim 1 and wherein said sealing element comprises a first locking element and a second locking element.

13. A package according to claim 12 and wherein said first locking element is inserted into said at least one sealable localized atmosphere communication aperture from inside of said package.

14. A package according to claim 12 and wherein said second locking element is inserted into said at least one sealable localized atmosphere communication aperture from outside of said package.

15. A package according to claim 12 and wherein said second locking element is screwed onto said first locking element.

16. A carton package according to claim 12 and wherein said sealing element also comprises a plug member.

* * * * *